US008888337B2

(12) United States Patent
Adams, IV et al.

(10) Patent No.: US 8,888,337 B2
(45) Date of Patent: Nov. 18, 2014

(54) DECORATIVE LIGHT CLIP

(75) Inventors: William E. Adams, IV, Zelienople, PA (US); Wililam E. Adams, Portersville, PA (US)

(73) Assignee: Adams Mfg. Corp., Portersville, PA (US)

( * ) Notice: Subject to any disclaimer, the term of this patent is extended or adjusted under 35 U.S.C. 154(b) by 272 days.

(21) Appl. No.: 13/324,522

(22) Filed: Dec. 13, 2011

(65) Prior Publication Data

US 2013/0148366 A1 Jun. 13, 2013

(51) Int. Cl.
*F21V 21/088* (2006.01)

(52) U.S. Cl.
USPC ..... 362/396; 362/287; 362/427

(58) Field of Classification Search
CPC ..... F21V 21/088
USPC ..... 362/396, 249, 250, 285, 287, 427, 430, 362/806, 229; 248/316.7, 48.2, 221.4, 248/220.2, 74.2, 309.1
See application file for complete search history.

(56) References Cited

U.S. PATENT DOCUMENTS

| | | | | |
|---|---|---|---|---|
| 5,433,413 | A * | 7/1995 | Adams | 248/205.3 |
| 5,607,230 | A | 3/1997 | Protz, Jr. | |
| 5,609,415 | A * | 3/1997 | Protz, Jr. | 362/396 |
| D385,776 | S | 11/1997 | Protz, Jr. | |
| 5,772,166 | A | 6/1998 | Adams | |
| 5,772,168 | A | 6/1998 | Nakazawa et al. | |
| D402,396 | S | 12/1998 | Protz, Jr. | |
| D414,291 | S | 9/1999 | Gary et al. | |
| D424,418 | S | 5/2000 | Gary et al. | |
| 6,076,938 | A | 6/2000 | Kinderman | |
| D427,510 | S | 7/2000 | Gary et al. | |
| 6,158,095 | A * | 12/2000 | Lassiter | 24/339 |
| 6,328,459 | B1 * | 12/2001 | Adams | 362/396 |
| 6,338,460 | B1 * | 1/2002 | Rumpel | 248/229.16 |
| D460,912 | S * | 7/2002 | Gary et al. | D8/395 |
| 6,572,062 | B1 | 6/2003 | Limber et al. | |
| D481,927 | S | 11/2003 | Wu | |
| 6,685,151 | B2 | 2/2004 | Vasquez et al. | |
| D494,849 | S | 8/2004 | Jones et al. | |
| 6,792,653 | B2 * | 9/2004 | Protz | 24/485 |
| D510,018 | S | 9/2005 | Tognolini | |
| D531,018 | S * | 10/2006 | Jackson et al. | D8/395 |
| D537,330 | S | 2/2007 | Cox et al. | |

* cited by examiner

*Primary Examiner* — Anh Mai
*Assistant Examiner* — Fatima Farokhrooz
(74) *Attorney, Agent, or Firm* — Buchanan Ingersoll & Rooney PC

(57) ABSTRACT

A clip for holding decorative lights has a clamp portion and a light holding portion connected by a bridge. The light holding portion and the bridge lie in a common plane and are formed as a unitary plastic body. The clamp portion has a leg tapered at one end and a second end which is connected to a bridge portion that holds the bridge and is connected to a clamping arm forming a corner which has an opening. A hook is provided on the end of the arm which defines a space of sufficient size to receive a rope light. The arm and the hook are sized and configured so that the leg and the hook can engage opposite surfaces of the roofing shingle. The light holding portion can be broken away from the clamp portion. Then the two pieces can be connected together in a different configuration.

12 Claims, 6 Drawing Sheets

DECORATIVE LIGHT CLIP

FIELD OF THE INVENTION

The invention relates to mounting clips for attaching decorative lights to various structures and for holding other objects that contain a generally cylindrical body or body portion.

DESCRIPTION OF THE PRIOR ART

The use of lights for decorating the exterior of a house is well known. Decorative lights typically consist of a large number of light sockets being wired together with light bulbs positioned in the light sockets. The "string" of lights is then attached to the face of a building. The "string" of lights can be mounted by retaining either the light socket or the wire. In recent years rope lights and icicle lights have become popular. Rope lights consist of a string of miniature lights inside a transparent or translucent tube. Icicle lights have a series of short strands of light that when hung extend downward form a horizontal cord.

Oftentimes, staples or hooks having a threaded shank are used to connect these ornamental objects to a house. These fasteners, however, are often not reusable by the consumer. Moreover, they can be difficult to dismount from the ornamental objects and the house. For example, staples used to fasten ornamental lights to a house must be pulled off and then thrown away by a user. Pulling the staples out of the house is extremely time consuming due to the small size of the staples and the difficulty in moving a lever between the house and a staple to pull each staple out of the house without damaging the attached ornament. Hooks with threaded ends leave a hole in structure after they are removed. Metal hooks may rust.

Over the years a variety of removable plastic clips or holders have been developed for attaching decorative lights to gutters, shingles and siding. The object of these clips and holders is to display the lights so that they can easily be seen. They must not be adversely affected by cold temperatures and should be able to hold the lights during high winds which commonly accompany winter storms. These clips rely on a user to apply manual force to lock the clip onto an existing profile on the house, such as shingles, gutters, or shutters. As a result, these clips are typically only able to connect to a limited number of structures on a house that may resemble the existing profile relied upon by the clip. Moreover, such clips are often difficult to remove from the house. In fact, when a user does manage to remove such clips, a user may damage the structure to which the clip is attached.

For example, U.S. Pat. No. 5,609,415 to Protz, Jr. discloses a two piece light clip for attachment to shingles or gutters that permit lights to be angularly oriented with respect to the roof line. The two part clip comprises an attaching body that attaches to a gutter or shingle and another body that attaches the light to the attaching body. Protz teaches that the attaching body of his clip should have no less than three different contact areas between a gutter and the clip. The clip disclosed by Protz, however, does not solve the problems associated with removing the clip. For instance, Protz's clip requires the removal of two separate bodies. Moreover, the attaching body, similar to the clips discussed above, lock onto existing profiles of the shingles or gutters. Consequently, different attaching bodies are needed for different gutter or shingle designs. Further, these clips are difficult to remove without damaging the shingle or gutter part to which the clip is attached.

U.S. Pat. No. 5,772,166 discloses a mounting clip which has a mounting for attachment to a shingle or siding and a light holder portion which holds the socket of a decorative light. Various configurations of light holders are disclosed, ranging from U-shapes, to C-shapes which define a circular opening smaller than the socket of a decorative light. Yet none of the various configurations is suitable for mounting all types of decorative lights to shingles or gutters so that the lights are readily visible.

Several plastic light holders known in the art are configured such that the light holder will fit under a shingle and when rotated ninety degrees will fit onto a gutter. Yet, many of these clips hold the bulb in the same orientation relative to the clip such that the light bulb will be vertical to the roof edge when the clip is attached to a shingle and the bulb will be horizontal when the light clip is attached to a gutter. It is preferred that the light bulb always be in the vertical position (i.e. vertical to the ground) on a gutter. In addition to not hanging bulbs on gutters with optimal positioning and placement, some of these clips hang rope lights in a position where they are hardly visible when hung on gutters. There are other weaknesses of these types of clips including their bulky size, the insecurity of the grip on cords, the inability to hold some sizes of bulb well, the insecurity of grip of the clip onto shingle and gutters, and the difficulty involved with hanging some types of cords or bulbs.

Consequently, there remains a need to provide a reusable clip or holder for decorative lights that is capable of attaching decorative light strings which have any size light bulb, as well as rope lights and icicle lights onto shingles or gutters of a house that is easy for a user to attach to and remove from the house. The clip should be capable of always holding the light bulb in a vertical orientation on gutters, and of holding all other lights (regardless of if they are held by cord or bulb) in optimal positions to create nicer looking light displays. The clip should be easy to use and it should hold securely. Also, it should be more sustainable by eliminating wasted plastic and inefficient logistics.

SUMMARY OF THE INVENTION

We provide a clip for holding decorative lights which has a clamp portion, a light holding portion and a bridge. The bridge connects the clamp portion to the light holding portion such that the clamp portion, the light holding portion and the bridge lie in a common plane and are formed as a unitary plastic body. The clamp portion has a leg tapered at one end and a second end which is connected to a bridge portion that holds the bridge. The bridge portion is also connected to a clamping arm forming a corner which has an opening. A hook is provided on the end of the arm which defines a space of sufficient size to receive a cord for any type of lights except rope lights. The arm and the hook are sized and configured so that the hook will be adjacent the leg and the hook and leg together define a space between them in which a roofing shingle can be inserted such that the leg and the hook will engage opposite surfaces of the roofing shingle. The light holding portion has a U-shaped body, a projection extending from the U-shaped body and a stake attached to the projection. The stake is sized and configured to fit into and be retained in the opening in the corner of the clamp portion.

As molded, the light holding portion can be used to hold rope lights on gutters, or it can be used to hold any type of light cord, including rope lights, on shingles. Alternatively, the light holding portion can be broken away from the clamp portion. Then it can be connected with the clamp portion by placing the stake of the light holding portion into the opening in the clamp portion. We prefer to provide a pair of teeth that extend into the opening in the corner of the clamp portion.

The light holding portion has a nub on the projection such that when the stake of the light holding portion is in the opening the nub may engage a selected one of the teeth to hold the light holding portion in one of two selected positions relative to the clamp portion.

Other objects and advantages of our clip for holding decorative lights can be appreciated from the present preferred embodiments thereof shown in the drawings.

DESCRIPTION OF THE PREFERRED EMBODIMENTS

Figure 2:
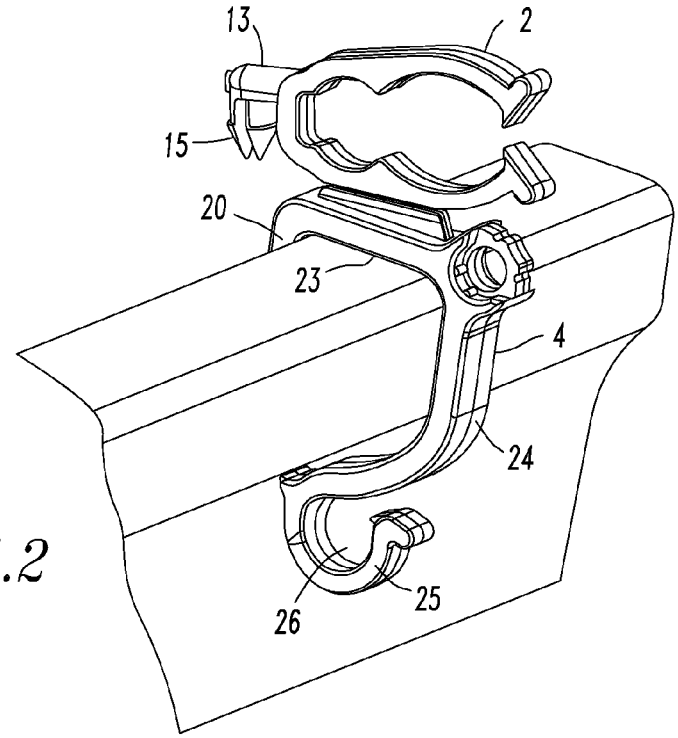
FIG. 2 is a perspective view of the clip shown in FIG. 1 attached to a gutter.
Figure 3:
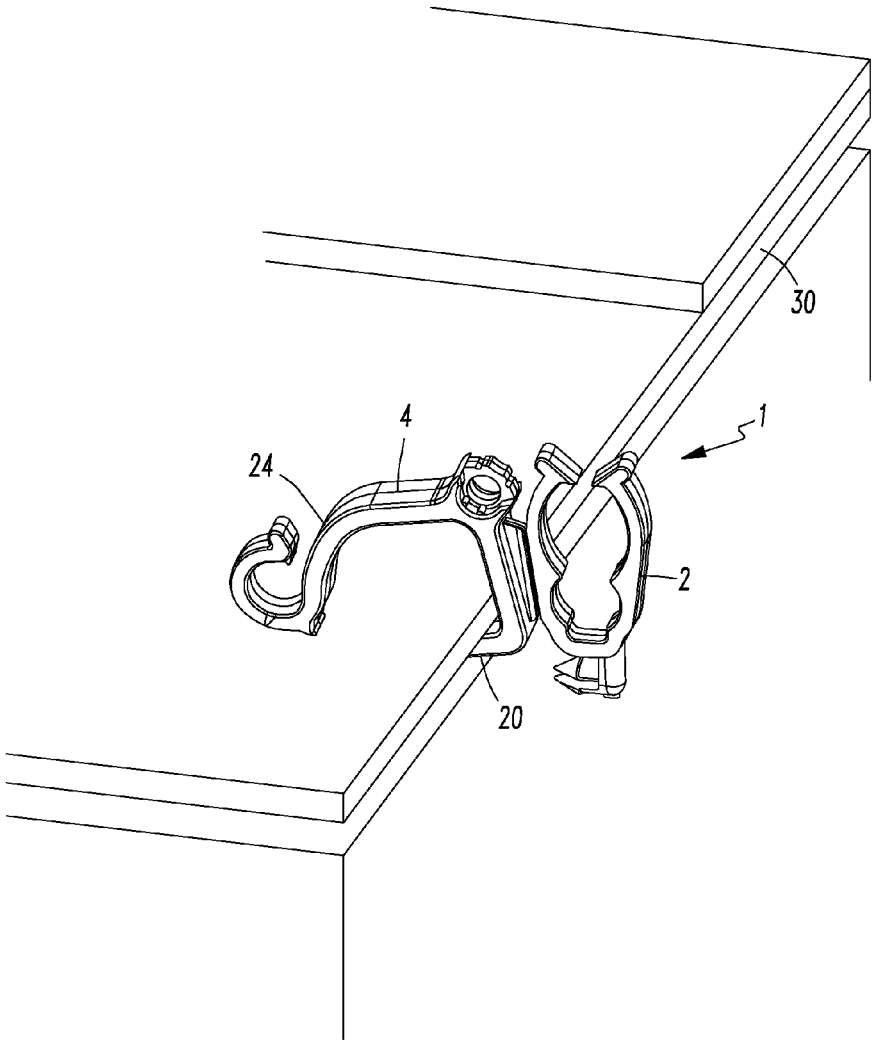
FIG. 3 is a perspective view of the clip shown in FIG. 1 attached to a shingles.
Figure 4:
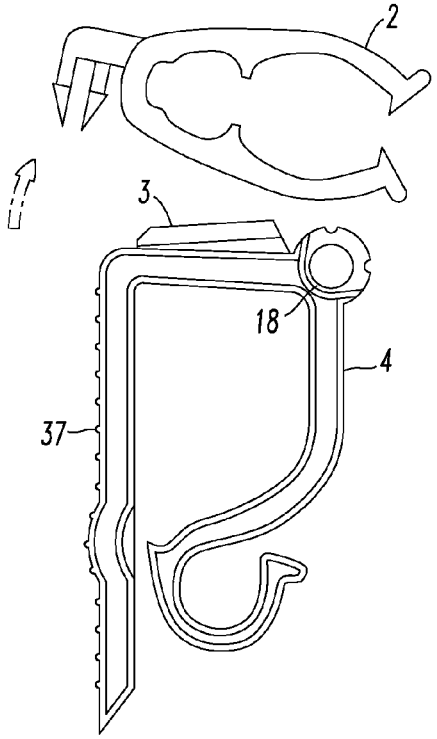
FIG. 4 is a side view of the clip shown in FIG. 1 showing the light holding portion being detached from the clamp portion and nodules on the leg of the clamp portion.
Figure 5:
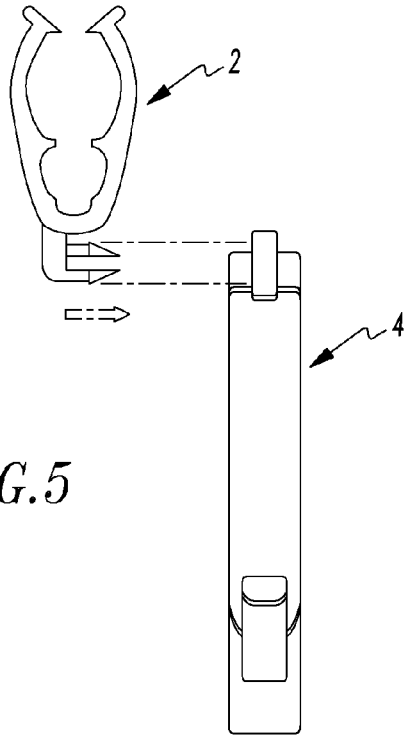
FIG. 5 is a front view of the clip shown in FIG. 1 showing the detached light holding portion being attached to the clamp portion.

A present preferred embodiment of our clip for holding decorative lights 1 shown in FIGS. 1 through 10 has a light holding portion 2 and a clamp portion 4 connected by a bridge 3. Preferably the light holding portion, the clamp portion and the bridge are a unitary molded plastic structure made from polypropylene or other plastic. These two portions can be detached from one another by breaking the bridge as shown in FIG. 4 and reconnecting the light holding portion to the clamp portion as shown in FIG. 5 to provide different configurations.

To provide sufficient strength to keep the holding portion attached to the clamp portion during use and yet allow them to be separated, we prefer to make the bridge wider at the center than at the ends. We prefer that either end of the bridge be about 0.017" wide for 0.050" along the length of the bridge. The center portion preferably is about 0.25" long and about 0.024" wide. A smooth transition can be provided between the different widths. Because the product is made of plastic some shrinkage will occur as the part comes out of the mold and cools. Therefore, these widths are approximate.

Figure 7:
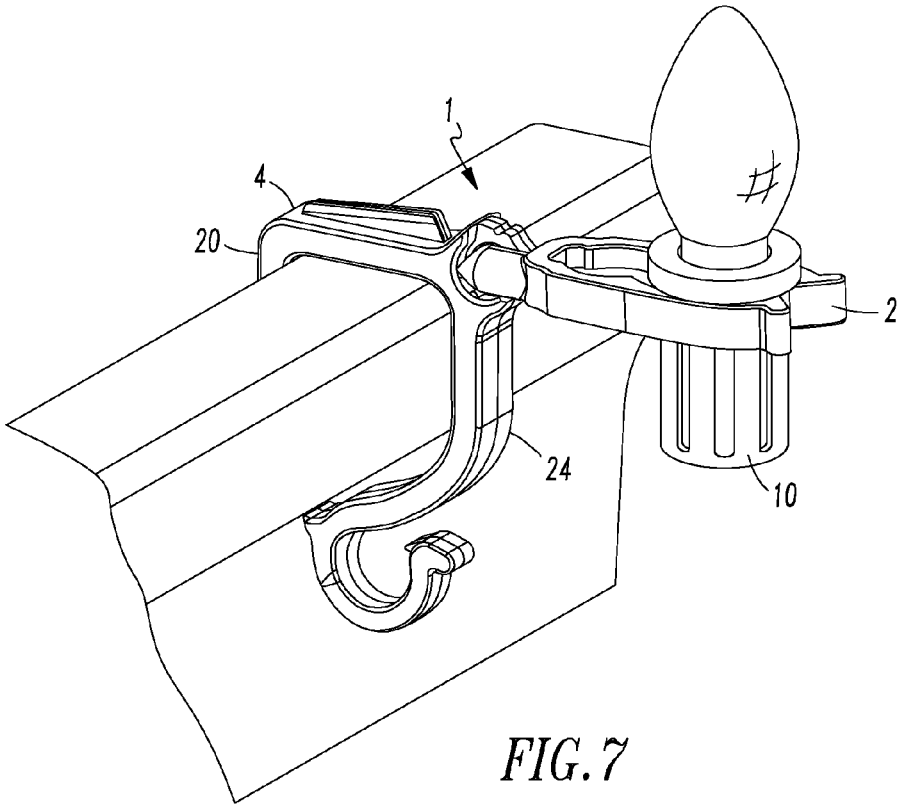
FIG. 7 is a perspective view of the clip shown in FIG. 6 attached to a gutter and holding a light.
Figure 9:
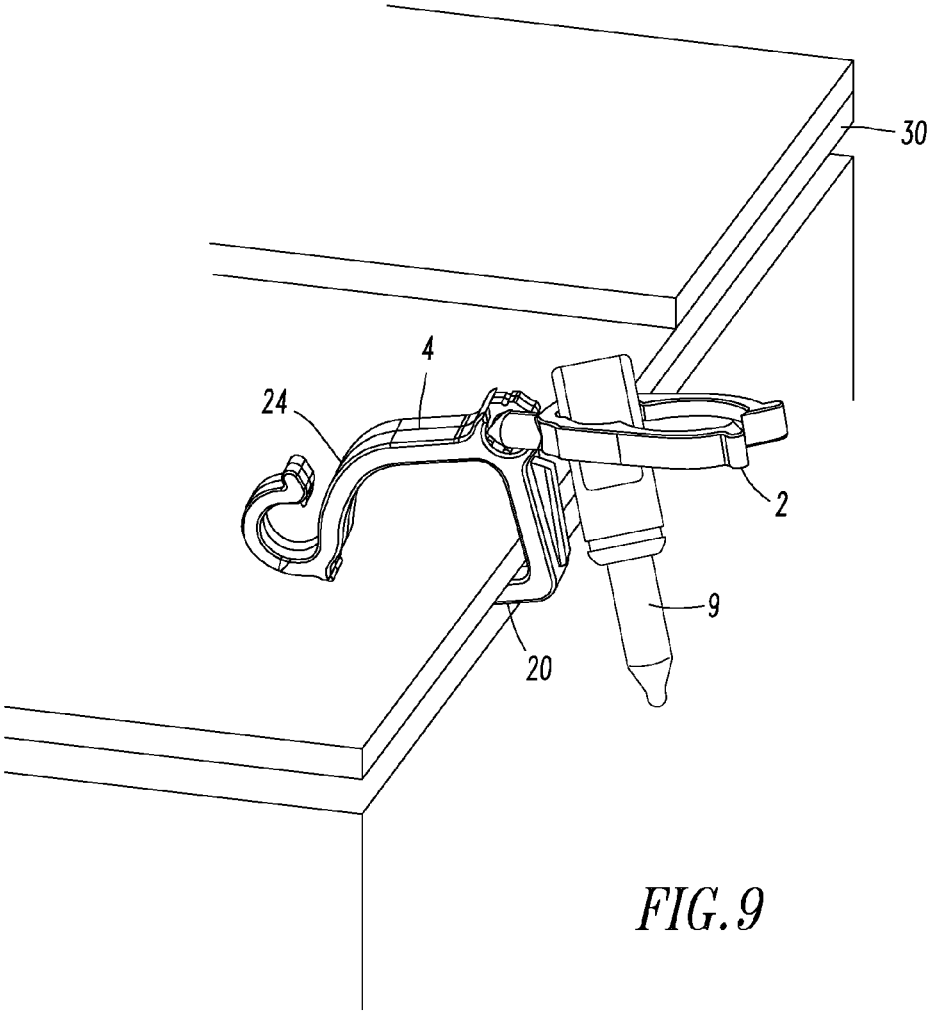
FIG. 9 is a perspective view of the clip shown in FIG. 6 attached to shingles and holding a mini-light.

The light holding portion 2 has a generally U-shaped body 6 comprised of a first arm 7 and a second arm 8 each having a pair of concave arcs or recesses which define openings 11 and 12. The opening 11 and 12 are of a different size allowing arms 7 and 8 to grip different size lights. The larger opening 11 can hold a C-7 or C-9 size light 10 as shown in FIG. 7 (as well as other variants of the "bigger bulbs" available on the market). Opening 11 also holds rope lights. The smaller recess 12 can hold a mini light 9 as shown in FIG. 9 (as well as other types of "smaller bulbs" available on the market such as C5 lights). We prefer to provide a tooth or projection 5 on each arm which engages a bulb socket to prevent some sizes of socket from slipping downward on that side. An arm 13 extends from the U-shaped body and has a bump or tooth 14 at the end of the arm. A split stake 15 extends substantially perpendicular from the arm 13. The split stake is sized to fit into the opening 22 on the clamp portion 4.

The clamp portion 4 has a leg 20, one end 21 of which is tapered. The opposite end of the leg is connected to a bridge portion 23 that holds bridge 3. The bridge portion is substantially perpendicular to the leg 20. The opposite end of the bridge portion is attached to one end of a clamping arm 24 at a corner 18. A portion of the clamping arm adjacent the bridge portion is substantially perpendicular to the bridge portion. The opposite end of the clamping arm is curved to create a hook 25 having an opening 26 which is sized to receive the cord portion of a string of decorative lights or icicle lights. We also prefer to provide a tooth 27 on the tip of the curved end that extends into opening 26. The tooth is tapered to facilitate insertion of the cord into opening 26. This tooth helps to secure cords in opening 26. A projection 28 is provided on the curved end 25 such that the projection 28 is opposite the leg 20. We prefer that the leg be curved opposite the projection to create a concave area or recess 19 on one side of the leg and a convex area or bump 38 on the opposite side of the leg. The projection 28 enables the clamping arm 24 and the leg 20 to securely hold a shingle or shingles between them. The bump 38 increases the friction of the leg and the drip edge (or possibly the leg and another shingle if the user places the leg between two shingles instead of between the bottom shingle and the drip edge) when the clip is attached to a shingle as shown in FIG. 9. When the clamp portion is being placed on a gutter, the edge of the gutter can move into recess 19 as the clip is being pulled downward. We have found that if the slide rib 39 is absent, the clip can get hung-up when being installed as the edge of the gutter catches in the recess 19. However, the slide rib 39 reduces the interference allowing the clip to be easily pulled downward onto the gutter without catching as the gutter edge passes over the recess 19. To provide better gripping on shingles we may place nubs or nodules 37 on the exterior surface of the leg as shown in FIG. 4. That surface could also be roughened or contain teeth or ribs.

Figure 1:
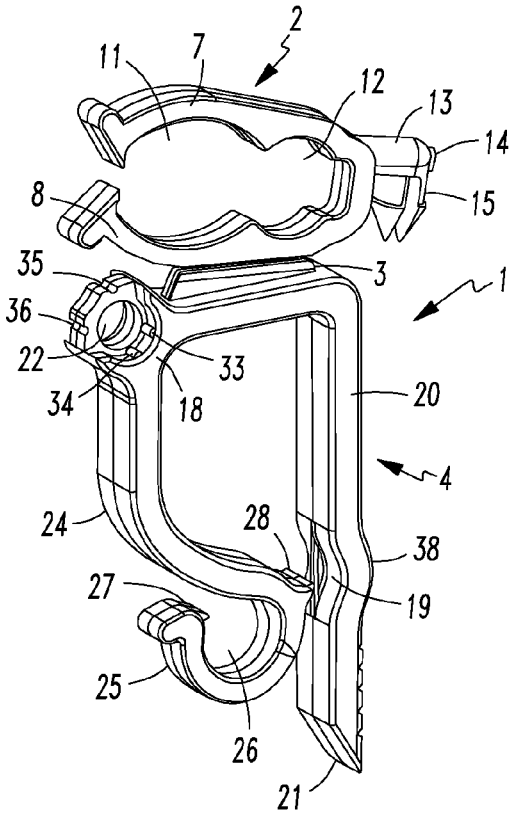
FIG. 1 is a perspective view of a present preferred embodiment our clip for holding for decorative lights in an as molded condition.

When the clip 1 is configured as shown in FIG. 1 the clamp portion 4 may fit over a gutter as shown in FIG. 2. When so positioned the light holding portion 6 will hold rope lights above the gutter in opening 11. As shown in FIG. 3 the clip in this configuration can also be attached to shingles 30 by pushing the leg 20 of the clamp portion under a shingle. The cord of a string of lights rather than a light socket should be held in the holding portion when the clip is configured as in FIG. 3, although some users with very steep gables might prefer to use the holding portion in that configuration to hold sockets.

Figure 6:
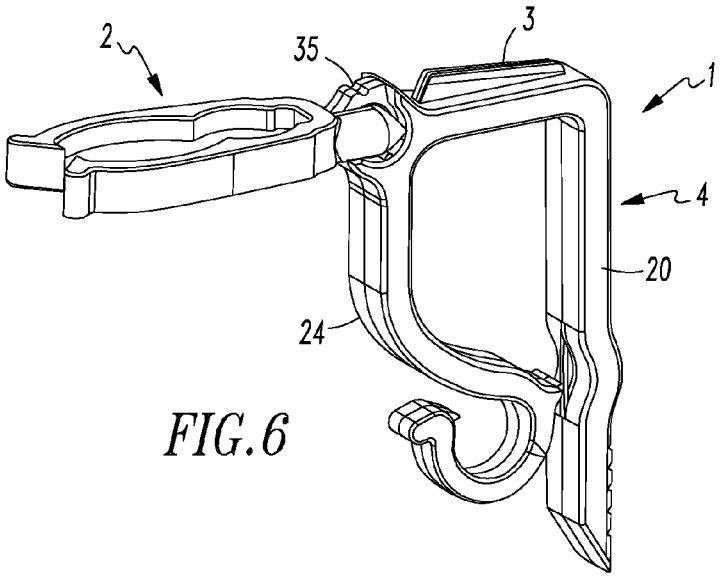
FIG. 6 is a perspective view of our clip for holding decorative lights in which the light holding portion has been broken away and repositioned on the clamp portion of the clip for attachment to a gutter.

Many homeowners prefer to mount their lights so that the bulb is oriented vertically relative to the ground on gutters, which the current clip is capable of doing. The clip preferably is sold in an as molded condition as shown in FIG. 1. The user may then separate the light holding portion 2 from the clamp portion 4 as indicated in FIG. 4. This can be done by either cutting the bridge or flexing the light holding portion relative to the clamp portion to break the plastic along the bridge. Preferably, the user can separate the light holding portion by simply swiveling the holding portion to a side then tearing upward on it. After the two portions have been separated the user then inserts the split stake 15 of the holding portion into the opening 22 in the clamp portion as indicated in FIG. 5. As can be seen most clearly in FIG. 10 there is a bump or tooth 14 at the base of the arm 13. There are also projections or teeth 33 and 34 on the holding portion 4 which extend towards opening 22. The teeth 33 and 34 cooperate with the bump or tooth 14 to hold the light holding portion in one of two positions relative to the clamp holding portion shown in FIGS. 6 and 8. We also prefer to provide seats 35 and 36 on the clamp portion. The seats help to hold the light holding portion in either of the positions shown in FIGS. 6 and 8. The first position shown in FIG. 6 is particularly suitable for attaching lights to the gutter. As can be seen in FIG. 7 the leg 20 fits into the gutter while the clamping arm 24 fits around the front of the gutter. The light holding portion is then oriented horizontally such that the light bulb 10 is vertically oriented relative to the ground.

Figure 8:
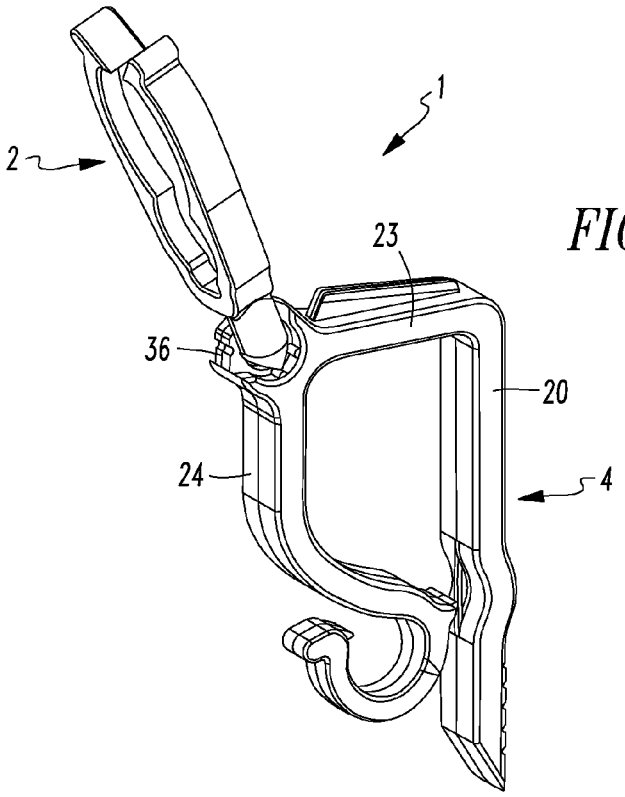
FIG. 8 is a perspective view of our clip for holding decorative lights in which the light holding portion has been broken away and repositioned on the clamp portion of the clip for attachment to a shingles.
Figure 10:
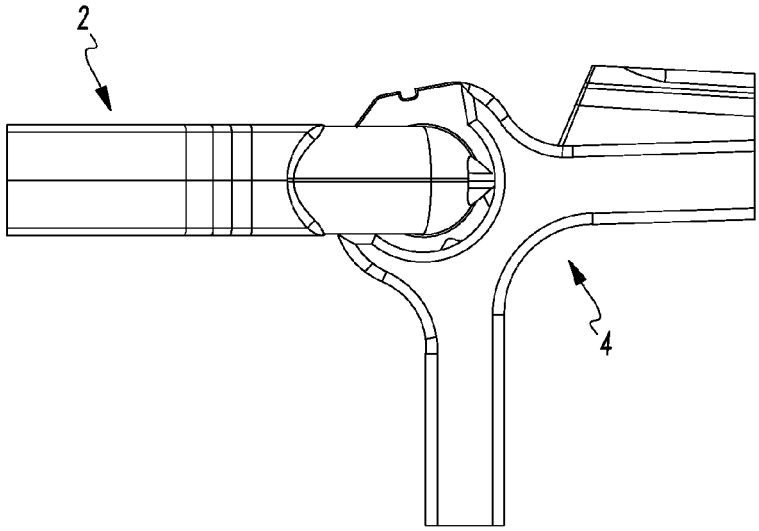
FIG. 10 is an enlarged fragmentary view showing the joint between the light holding portion and the clamp portion after the two sections have been detached and rejoined together in the manner shown in FIGS. 4 and 5.

In the second orientation shown in FIG. 8 the light holding portion 2 has been rotated nearly 90° from the position shown in FIG. 6. As can be seen in FIG. 8, however, the light holding portion 2 is not fully perpendicular to the bridge portion 23 of the clamp portion. When the clamp portion is mounted on shingles 30 as shown in FIG. 9 the clamping arm 24 will move away from the leg 20 causing the light holding portion to move downward. Consequently, the light holding portion will be horizontal and the decorative light such as mini light 9 will be held in a vertical orientation relative to the roof edge.

In addition to being able to hold lights on gutters in a vertical orientation, the present light clip has another significant advantage. The light clip is packaged in the as molded condition shown in FIG. 1. The light holding portion 2 and the clamp portion are close in width and lie in a common plain. We prefer that the width of the holding portion be about 0.15" and that of the clamp portion be about 0.25". Consequently, the clips can be stacked and packed close together for shipment. A package holding 100 clips shown in FIG. 1 is about 97 cu in. A package of 100 of a competitor's molded plastic clips is 213 cu in. The competitor's package is 121% larger. As a result more clips can be packed into a shipping crate or other container and the product takes up less space on the store shelf. Consequently, the per unit shipping cost for this clip will be lower than the per unit shipping cost for other molded plastic clips available in the market and more items can be displayed in a specific amount of retail space.

Another significant advantage of the present light clip is that the product can be made in single cavity mold using less plastic than many clips in the prior art.

Yet other significant advantages of the clips are their ease of use, their ability to hold all types of lights more optimally on shingles and gutters for nicer displays than can be achieved with other clips on the market, their security of grip on cords, bulbs, shingles, and gutters so that users can decorate once and have their decorations stay precisely in place throughout the decorating season.

While we have shown and described certain present preferred embodiments of our clip for holding decorative lights it will be distinctly understood that the invention not limited thereto but may be variously embodied within the scope of the following claims.

We claim:

1. A clip for holding decorative lights comprised of a clamp portion, a light holding portion and a bridge, the bridge connecting the clamp portion to the light holding portion such that the clamp portion, the light holding portion and the bridge lie in a common plane and are formed as a unitary plastic body wherein:

the clamp portion is comprised of:

a leg tapered at one end and having a second end;

a bridge portion having a first end and a second end, the second end of the bridge portion connected to the second end of the leg such that the bridge portion and the leg are substantially perpendicular to one another;

an arm having a first end connected to the first end of the bridge portion at a corner such that a portion of the arm adjacent the bridge portion and the bridge portion are substantially perpendicular to one another, the corner having an opening, the arm having a second end with a hook at the second end, the hook having a distal end and defining a space of sufficient size to receive a rope light; wherein the arm and the hook are sized and configured so that the hook will be adjacent the leg and the hook and leg together define a space between them in which a roofing shingle can be inserted such that the leg and the hook will engage opposite surfaces of the roofing shingle; and the light holding portion comprising a U-shaped body having a pair of spaced apart arms, an arm extending from the U-shaped body and a stake attached to the arm, the stake sized and configured to fit into and be retained in the opening in the corner of the clamp portion;

wherein one arm of the pair of spaced apart arms is attached to the bridge portion by the bridge, the bridge portion having a length and a width, the bridge having a length that is shorter than the length of the bridge portion, the bridge having a width that is narrower than the width of the bridge portion so that the light holding portion can be broken away from the clamp portion.

2. The clip for holding decorative lights of claim 1 wherein the clamp portion and the light holding portion and the clamp portion each have a width and the width of the clamp portion and the width of the light holding portion are the same.

3. The clip for holding decorative lights of claim 2 wherein the width of the clamp portion and the width of the light holding portion are about 0.25 inches.

4. The clip for holding decorative lights of claim 1 wherein the clamp portion has a pair of teeth that extend into the opening in the corner of the clamp portion and the light holding portion has a tooth on the arm such that when the stake of the light holding portion is in the opening the tooth on the arm may engage a selected one of the teeth on the clamp portion to hold the light holding portion in one of two selected positions relative to the clamp portion.

5. The clip for holding decorative lights of claim 1 wherein the leg has a concave portion opposite the hook and also comprising a projection on the hook that extends toward the concave portion of the leg.

6. The clip for holding decorative lights of claim 5 wherein the leg has a convex portion opposite the concave portion.

7. The clip for holding decorative lights of claim 1 wherein the bridge has a first end, a second end and a center portion between the first end and the second end, the center portion being wider than the ends.

8. The clip for holding decorative lights of claim 7 wherein the ends of the bridge have a width of about 0.17 inches and the center portion has a width of about 0.050 inches.

9. The clip for holding decorative lights of claim 7 wherein the ends have a length of 0.010 inches and the center portion has a length of about 0.25 inches.

10. The clip for holding decorative lights of claim 1 wherein the clamp portion, the light holding portion and the bridge are polypropylene.

11. The clip for holding decorative lights of claim 1 wherein the U-shaped body has in inner surface having two pairs of arcs, each pair of arc defining an opening sized to receive a decorative light.

12. The clip for holding decorative lights of claim 11 also comprising at least one tooth on the inside surface of the U-shaped body.

* * * * *